US006822182B2

(12) United States Patent
Kechel

(10) Patent No.: US 6,822,182 B2
(45) Date of Patent: Nov. 23, 2004

(54) METHOD OF SORTING MAIL FOR CARRIERS USING SEPARATORS

(75) Inventor: Ottmar K. Kechel, Irving, TX (US)

(73) Assignee: Siemens Dematic Postal Autoamtion, L.P., Arlington, TX (US)

( * ) Notice: Subject to any disclaimer, the term of this patent is extended or adjusted under 35 U.S.C. 154(b) by 152 days.

(21) Appl. No.: 10/194,806

(22) Filed: Jul. 12, 2002

(65) Prior Publication Data

US 2004/0007510 A1 Jan. 15, 2004

(51) Int. Cl.[7] ..... B07C 5/00
(52) U.S. Cl. ..... 209/584; 209/900
(58) Field of Search ..... 209/583, 584, 209/900; 700/223, 224, 225, 226

(56) References Cited

U.S. PATENT DOCUMENTS

| | | | | | |
|---|---|---|---|---|---|
| 3,261,464 | A | * | 7/1966 | Levy | 209/552 |
| 3,889,811 | A | * | 6/1975 | Yoshimura | 209/549 |
| 4,247,008 | A | * | 1/1981 | Dobbs | 209/569 |
| 4,388,994 | A | * | 6/1983 | Suda et al. | 209/564 |
| 6,316,741 | B1 | * | 11/2001 | Fitzgibbons et al. | 209/584 |
| 6,501,041 | B1 | * | 12/2002 | Burns et al. | 209/584 |
| 2003/0208298 | A1 | * | 11/2003 | Edmonds | 700/224 |
| 2004/0035762 | A1 | * | 2/2004 | Brown | 209/584 |

FOREIGN PATENT DOCUMENTS

| | | |
|---|---|---|
| WO | WO 02/00362 A2 | 1/2002 |

* cited by examiner

*Primary Examiner*—Donald P Walsh
*Assistant Examiner*—Joseph Rodriguez
(74) *Attorney, Agent, or Firm*—Philip G. Meyers

(57) ABSTRACT

A method for sorting mail pieces for delivery by a carrier, wherein the mail pieces include both letters and flats, includes the steps of a) sorting in a first sorting pass a batch of letters, each letter having a destination code thereon which corresponds to one of a predetermined number of delivery destinations for a carrier delivery route, b) sorting in first sorting pass a batch of flats, each flat having a destination code thereon which corresponds to one of the predetermined number of delivery destinations for the carrier delivery route, using the same automated sorting machine which scans each delivery code and stores it in a computer memory; c) sorting in a first sorting pass a batch of dividers having a scannable code thereon; d) then sorting the letters, flats and dividers in at least one subsequent sorting pass, using the scanned and stored codes according to the computer-implemented sort scheme, resulting in a series of groups of mail pieces for each destination, which groups may include letters only, flats only, or both letters and flats, and which groups are in delivery route order, with a divider between each group.

9 Claims, 3 Drawing Sheets

METHOD OF SORTING MAIL FOR CARRIERS USING SEPARATORS

BACKGROUND OF THE INVENTION

Each day more than 200,000 United States Postal Service (USPS) carriers deliver mail to approximately 100 million individual domestic addresses. Each day, before a carrier begins to walk through or drive through his or her delivery route, it is the carrier's responsibility to put all of this mail into an appropriate sequence for efficient delivery. Under the present USPS procedure, the carrier assembles at least three delivery order sequenced stacks of mail, including letters, flats (including enveloped and non-enveloped magazines), and parcels. As used herein "letter sized" or "letter" generally refers to envelopes, postcards and similar mail pieces having dimensions up to about 5"×10". "Flats" as used herein generally refers to larger, flat mail pieces having dimensions larger than about 5"×10", and includes catalogues, magazines, larger envelopes and similar items. At each delivery stop the carrier selects the items for that address from each of the various stacks and puts them all into the postal patron's mailbox. This sorting and shuffling through various stacks of mail is time consuming, inefficient, and consequently expensive to the USPS. Consequently, any reduction in the number of sequenced stacks that have to be sorted and shuffled through during delivery represents the potential for increased efficiency.

To put mail in destination point order, a Delivery Bar Code Scanner (DBCS) and/or Carrier Sequence Bar Code Scanner (CSBCS) DBCS machine typically uses a multi-pass sorting scheme. Two and three pass schemes based on significant digits of the delivery points are most common. These known strategies are explained in detail in U.S. Pat. No. 5,363,971. In general, a multi-pass sort scheme starts with a disordered collection of mail having a common zip code and ends up with the same mail in a series of batches, one for each delivery point receiving mail. In order to accomplish the sort, intermediate batches of partially sorted mail are created that are then fed back into the sorter again for sorting according to a second pass sort scheme.

The result of this sorting process is, as noted above, multiple stacks of delivery ordered mail. In order to identify, for example, letters addressed to a specific address, the carrier "thumbs" through the stack, finding the first and last letter addressed to the address, separating the letters addressed to the address from the stack. This time consuming process is repeated with the stack of flats.

The invention set forth below provides a method of reducing the number of stacks that the letter carrier is required to go through and simplifies the process of separating mail pieces addressed to a specific destination from the stack.

SUMMARY OF THE INVENTION

A multi-pass sorting method for sorting mail pieces including both letter and flats and for delivery by a carrier, using a computer-implemented sort scheme includes the steps of: a) sorting in a first sorting pass a batch of letters, each letter having a destination code thereon which corresponds to one of a predetermined number of delivery destinations for a carrier delivery route, using an automated sorting machine which scans each delivery code and stores it in a computer memory, b) sorting in first sorting pass a batch of flats, each flat having a destination code thereon which corresponds to one of the predetermined number of delivery destinations for the carrier delivery route, using the same automated sorting machine which scans each delivery code and stores it in a computer memory, c) sorting in a first sorting pass a batch of dividers, one divider for each destination, and d) then sorting the letters, flats and dividers in at least one subsequent sorting pass, using the scanned and stored delivery codes according to the computer-implemented sort scheme, resulting in a series of groups of mail pieces for each destination, which groups may include letters only, flats only, or both letters and flats, and which groups are in delivery route order, with a divider between each group. The foregoing method creates a stack of mail in delivery order with dividers separating mail pieces destined for different addresses such that the carrier can readily and easily separate mail pieces for different destinations without the necessity of thumbing or shuffling though a stack of mail.

In an alternate variation, mail pieces destined for different destinations are separated with dividers only when adjacent mail pieces in the stack that are destined for different destinations or addresses are of the same type. In variation, after one or more initial passes using the scanned and stored delivery codes according to a computer-implemented sort scheme groups of mail pieces for each destination may include letters only, flats only, or both letters and flats in delivery route order. The groups containing letters only and flats only are then identified and in a final pass a divider is inserted between adjacent groups in the series whenever a group containing letters or flats only appears such that flats for one destination would otherwise be grouped consecutively with flats for another destination, or letters for one destination would otherwise be grouped consecutively with letters for another destination.

In yet another variation, the sequence into which the mail pieces will be sorted is determined during one or more initial passes through the sorter, and the locations in the stack where adjacent mail pieces of the same type are destined for delivery to different addresses are identified. In a final sort, a divider is inserted between adjacent mail pieces of the same type, for example two letter or two flats where the second mail piece is addressed to a different address than the first mail piece.

In another aspect the invention provides a method for sorting mail pieces for delivery by a carrier, wherein the mail pieces include both letters and flats, including the steps of a) sorting in a first sorting pass a batch of mail pieces, including letters and flats, each having a destination code thereon which corresponds to one of a predetermined number of delivery destinations for a carrier delivery route, using an automated sorting machine which scans each delivery code and stores it in a computer memory, and b) sorting in a subsequent pass the batch of mail pieces and a plurality of dividers using the scanned and stored delivery codes according to a computer-implemented sort scheme which results, after two or more sorting passes, in a series of groups of mail pieces for each destination, which groups may include letters only, flats only, or both letters and flats with a divider between adjacent groups. In this regard, the mail carrier may separate the individual groups as he or she conducts his route without shuffling or thumbing through stacks of mail to locate mail pieces addressed to a particular destination.

DETAILED DESCRIPTION

Figure 1:
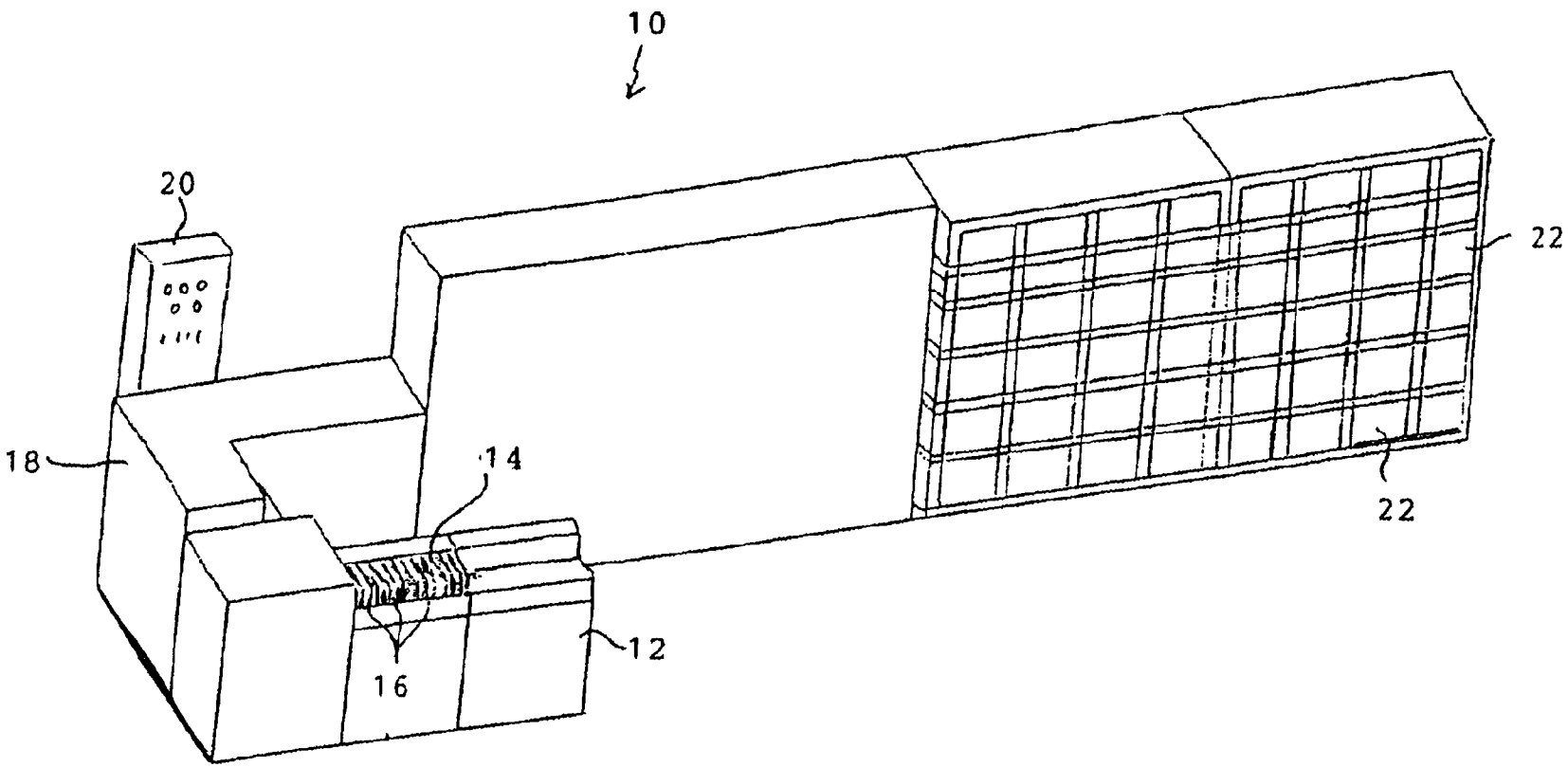
FIG. 1 is a schematic representation of a mail sorting and handling system for use in a method according to the invention.

Referring now to FIG. 1, a mail sorting machine 10 includes a feeder/singulator 12 where an unordered stack 14 of mail pieces are loaded for sorting. The feeder mail pieces are conveyed from feeder 12 as a singulated stream of mail pieces 16 to a scanner 18 such as a bar code scanner or an optical character recognition (OCR) apparatus. Scanner 18 reads destination information from mail pieces 16 and transmits the information to a control computer 20 which stores the destination information and identifies the bin 22 where the mail piece is to be directed. Each mail piece is then conveyed and diverted into a selected bin 22 based upon the destination code. Computer 20 stores the location (bin 22) where the mail piece is located. Thus, computer 20 contains the destination information and bin location where each mail piece has been sorted to along with the order in which the mail pieces are stacked in each bin. Although as illustrated, sorting machine 10 utilizes a multi tiered array of bins 22, machine 10 may also be configured with a single horizontal row of bins 22.

Computer 20 also stores information regarding the physical characteristics of the mail piece, i.e., whether the mail piece is a letter or larger piece, such as a catalogue or magazine, commonly referred to as flats. The size of the mail piece may be determined with one or more sensors associated with feeder 12 or may be bar-coded onto the mail piece, in which case the information is acquired with scanner 18 and transmitted to computer 20.

In order to efficiently utilize available bins 22, current mail sorting schemes frequently involve multiple pass sorting in which mail items are sorted in a series of steps or passes. The mail pieces are fed from a scanner through a series of diverters which divert individual mail pieces into bins or pockets based upon a first scanned indicia. The stacks of mail from the individual bins are then manually or mechanically collected in sequence and replaced in the feed bin. The mail is processed through the sorter for a second pass, during which the mail is sorted into the bins based upon a second scanned indica. This process may be repeated a number of times, depending upon the level of the sort, i.e. national, regional or local, the number of destinations and the equipment used for sorting. As is known in the art, the number of destinations or categories into which items can be sorted using a multi-pass scheme is equal to the number of bins raised to the number of passes. Thus, for example, in the case of a typical carrier delivery route, containing approximately 1000 destinations, in order to sequentially sort mail for the route with two passes, a 32 bin sorter is required ($32^2$=1024).

At the local level, and specifically at the carrier level, the number of sorting categories is equal to the number of addresses (delivery points) on the carrier's route. Preferably, as much mail as possible is sorted into a single stack by destination for delivery, thereby minimizing the time spent by the carrier shuffling through individual stacks of mail.

For the purpose of illustration, assume that a carrier delivers mail to 25 destinations or numbers (1–25) on 5 streets (A–E), starting with address A-1 and proceeding by street and address number to E-25, a total of 125 destinations. A possible sorting scheme to sequence the mail for delivery in this scenario could use for example, a twenty-five bin sorter in a two pass sorting scheme. During the first pass through the sorter, the mail is sorted according to the street address, i.e., 1–25. Thus, after the first pass, the first bin would contain the mail for the first address on each street, i.e., A-1, B-1, . . . E-1. The second bin would contain the mail for the second address on each street, i.e., A-2, B-2 . . . E-2. The last bin would contain the mail for A-25, B-25, . . . E-25. The stacks would not, however be sorted by street.

In the next pass, the stacks would be sequentially placed in the feed bin to be sorted by street. Since only five streets are used in the scenario, only five bins would be used in the second sort. In the second pass, the first stack from the previous pass, containing all of the "1"'s would be sorted as follows: A-1 would be diverted into the first bin, B-1 would be diverted into the second bin, C-1 to the third, D-1 to the fourth and E-1 to the fifth. The second stack from the first pass, containing mail for destinations A-2 through E-2 would be sorted in the same fashion. Thus, upon completion of the second pass with the twenty-fifth stack, the previously unsorted stack of mail would be ordered sequentially for delivery.

After this process, the carrier collects the stack of letters, the stack of flats and parcels destined for delivery to addresses along his or her route. Before or during his or her route the carrier shuffles or thumbs through the stack of letters and the stack of flats, separating the items addressed to a particular location.

Recently, sorting machines and systems known as mixed mail sorters capable of sorting both letter sized and larger items, such as catalogues, brochures, magazines and similar items, normally identified as "flats" have been developed. These machines, used in conjunction with a method according to the invention, can reduce the number of stacks that the carrier must deal with and simplify the process of separating mail pieces destined for delivery to a specific location.

In a method according to the invention, a series of letters $L_1, L_2, L_3, \ldots L_n$ addressed to a plurality of destinations $A_1, A_2, A_3 \ldots A_n$ corresponding to a carrier route are loaded on feeder 12, singulated and directed through scanner 18 which reads scanned destination indicia from the letters and transmits the information to computer 20. Computer 20 assigns each letter to a bin 22 and sets an identifier Q equal to "L" indicating that the mail piece is a letter. The computer also stores the destination information for each letter and the bin to which the letter is to be directed.

After the letters have been sorted for the carrier route, the process is repeated for flats directed to addresses on the carrier route. A series of flats $F_1, F_{2,\ F3,\ \ldots\ Fm}$ addressed to a plurality of destinations $A_1, A_2, A_3, \ldots A_m$ corresponding to the route is loaded on feeder 12, singulated and directed through scanner 18 which reads scanned destination indicia from the flats and transmits the information to computer 20. Computer 20 assigns each letter to a bin 22 and sets an identifier Q equal to "F" indicating that the mail piece is a flat. The computer also stores the destination information for each flat and the bin number (B) to which the letter is to be directed. Thus after the letters and flats have been processed through the first pass, a record of $L_n$, $A_n$, $B_n$ will exist for each letter and a similar record $F_m$, $A_m$, $B_m$ will exist for each flat. With this information the computer can determine the location where each mail piece will be positioned relative to each other mail piece after the final pass through the sorter, at which time the mail pieces will be in delivery order for the carrier.

Ideally, the stack of mail pieces that the carrier receives for delivery would be separated by address so that the carrier would not have to thumb or shuffle through the stack to separate mail directed to different addresses. In a first method according to the invention, this separation is accomplished by inserting separator cards or dividers between mail pieces addressed to consecutive addresses. "Consecutive" in this context refers to the order in which the carrier delivers mail and "addresses" refers to those addresses identified from mail pieces during the sorting process. Thus the first and third addresses on the carriers route, ($A_1$ and $A_3$, respectively) are "consecutive" if no mail pieces are identified as directed to the second address ($A_2$) on the carrier's route during the sorting process.

Computer 20 determines the number of separator cards required (n+m−1)−d, where d is the number of destinations receiving both letter and flat mail, and directs the sorter to feed the required number of separator cards from a stack of separator cards loaded by the operator on feeder 12 after the first sorting pass has been completed. The separator cards are bar coded or otherwise identified with a scannable code to distinguish the separators form mail pieces. Since computer 20 contains a record $L_n$, $A_n$, $B_n$ or $F_m$, $A_m$, $B_m$ for each mail piece, sufficient information is stored to allow the computer to direct the separator cards to the appropriate bins so that the cards can be sorted to locations between consecutive addresses in one or more subsequent passes through the sorter. In this respect, computer 10 may be programmed to treat the separator cards as dummy mail pieces, assigning a separator card to each address to which a mail piece has been addressed and creating a record for each card, $C_n$, $A_n$, $B_n$,.

Figure 2:
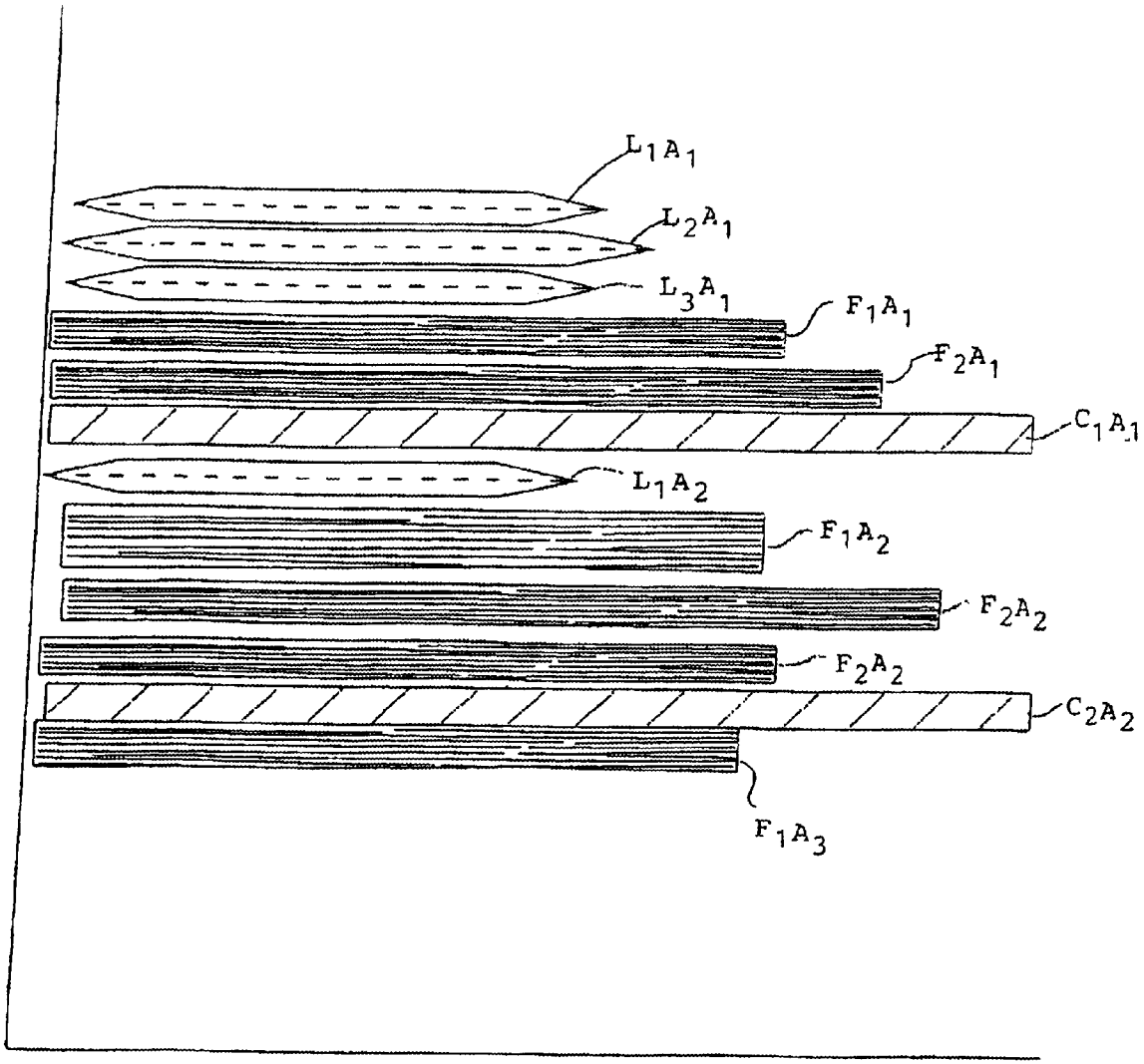
FIG. 2 is an illustration of a stack of mail pieces and separators sorted in accordance with a method of the invention.

After the separator cards have been sorted to the bins, the stack from each bin is manually or mechanically collected and re-fed through sorter 10 until the mail pieces and cards are ordered by consecutive addresses with a separator card inserted between mail pieces addressed to different addresses. As shown in FIG. 2, mail pieces sorted in the manner for delivery to the first two addresses on a carriers route could for example be ordered as follows:

| |
|---|
| $L_1$, $A_1$ |
| $L_2$, $A_1$ |
| $L_3$, $A_1$ |
| $F_1$, $A_1$ |
| $F_2$, $A_1$, |
| $C_1$, $A_1$ |
| $L_1$, $A_2$ |
| $F_1$, $A_2$ |
| $F_2$, $A_2$, |
| $F_3$, $A_2$ |
| $C_2$, $A_2$ |
| $F_1$, $A_3$ |

L = Letter
F = Flat
C = Separator Card

In the above example, three letters ($L_{1\text{-}3}A_1$) and two flats ($F_{1\text{-}2}A_1$) are sorted for delivery for the first address followed by a separator card ($C_1$, $A_1$) which serves to separate mail addressed to the first address ($A_1$) from mail destined for the second address ($A_2$). One letter ($L_1A_2$) and three flats ($F_{1\text{-}3}A_2$) are addressed to the second address, again followed by a separator card ($C_1$, $A_2$) that separates the last flat ($F_3$, $A_2$) from the single flat addressed to the third address on the carriers route. It may also be desirable to program computer 20 to direct sorter 10 to insert a card at locations in the stack corresponding to each address or stop on the carrier's route regardless of whether the stack contained mail pieces addressed to a particular stop. In this variation, the presence of consecutive separator cards in the stack of mail pieces alerts the carrier that stops at one or more addresses on the route are not required. Thus, in the above example if no mail pieces were directed to the second address, the stack would appear as follows:

$L_1$, $A_1$
$L_2$, $A_1$
$L_3$, $A_1$
$F_1$, $A_1$
$F_2$, $A_1$,
$C_1$, $A_1$
$C_2$, $A_2$
$C_3$, $A_3$
$F_1$, $A_3$

In this example the presence of consecutive separator cards, $C_1$, $A_1$, $C_2$, $A_2$ and $C_3$, $A_3$ would indicate to the carrier that he or she could pass the second address without stopping, thereby simplifying and speeding the delivery process.

Preferably, the separator cards are readily identifiable from either letters or flats both visually and tactilely in order to allow the carrier to rapidly and conveniently separate mail from the stack. In this respect, the separator cards could be brightly colored and formed from a material tactilely distinguishable from most letters and flats, for example from a relatively stiff piece of an appropriately selected plastic. In this manner, the carrier can readily separate and grasp the mail pieces destined for a given address from the stack, without having to visually examine the stack to separate the mail for that address.

In an alternative method according to the invention, mail pieces may be used as separators. As noted above, flats are mail pieces such as magazines and catalogues that are larger than letters. Thus, for example, one or more flats are utilized to separate mail going to consecutive addresses on the carrier's route were possible while separator cards are used only as required to separate adjacent mail pieces of the same type destined for consecutive addresses.

In this respect, letters and flats are sorted as described above with computer 20 generating records $L_n$, $A_n$, $B_n$ or $F_m$, $A_m$, $B_m$ for each mail piece. Computer 20 is programmed to identify those locations in the final ordered stack where adjacent mail pieces of the same type, i.e., flats or letters are destined for delivery to consecutive addresses. For example computer 20 may identify the following sequence of mail pieces for the third, fourth, fifth and sixth addresses on the carrier's route:

$L_1$, $A_3$
$L_2$, $A_3$
$F_1$, $A_3$,
$L_1$, $A_4$
$L_2$, $A_4$
$F_1$, $A_5$
$F_2$, $A_5$,
$F_1$, $A_6$

In the above sequence, two letters ($L_1$, $A_3$ and $L_2$, $A_3$) and one flat ($F_1$, $A_3$)are destined for the third address on the carrier's route, two letters ($L_1$, $A_4$, $L_2$, $A_4$) are destined for the fourth address, a letter ($L_1$, $A_5$) and two flats ($F_1$, $A_5$, $F_2$, $A_5$) are destined for the fifth address and a single flat ($F_1$, $A_6$) is directed to the sixth address. Separating adjacent mail pieces of the same type addressed to consecutive addresses, in this case $L_2, A_4$ from $L_1, A_5$ and $F_2, A_5$ from $F_1, A_6$, will require more attention on the part of the carrier since the carrier is separating items having the same physical dimensions. On the other hand, separating mail pieces of different types destined for consecutive addresses, for example $F_1, A_3$ from $L_1, A_4$ requires less attention and can be accomplished faster due to the different dimensions of flat $F_1, A_3$ and letter $L_1, A_4$.

Thus, in one variation of the method of the invention, computer 20 is programmed to identify, in advance, the locations in the final ordered stack where adjacent mail pieces of the same type, i.e., flats or letters are destined for delivery to consecutive addresses and insert a separator at these locations during the sorting process. In the above example, after the first pass, computer 20 would determine that a separator card is required between $L_2, A_4$, and $L_1, A_5$ and also between $F_2, A_5$ and $F_1, A_6$. No separator card is used between flat $F_1, A_3$ and letter $L_1, A_4$ since $F_1, A_3$ insofar as flat $F_1, A_3$ serves to separate mail pieces addressed to $A_3$ from mail pieces addressed to $A_4$.

Figure 3:
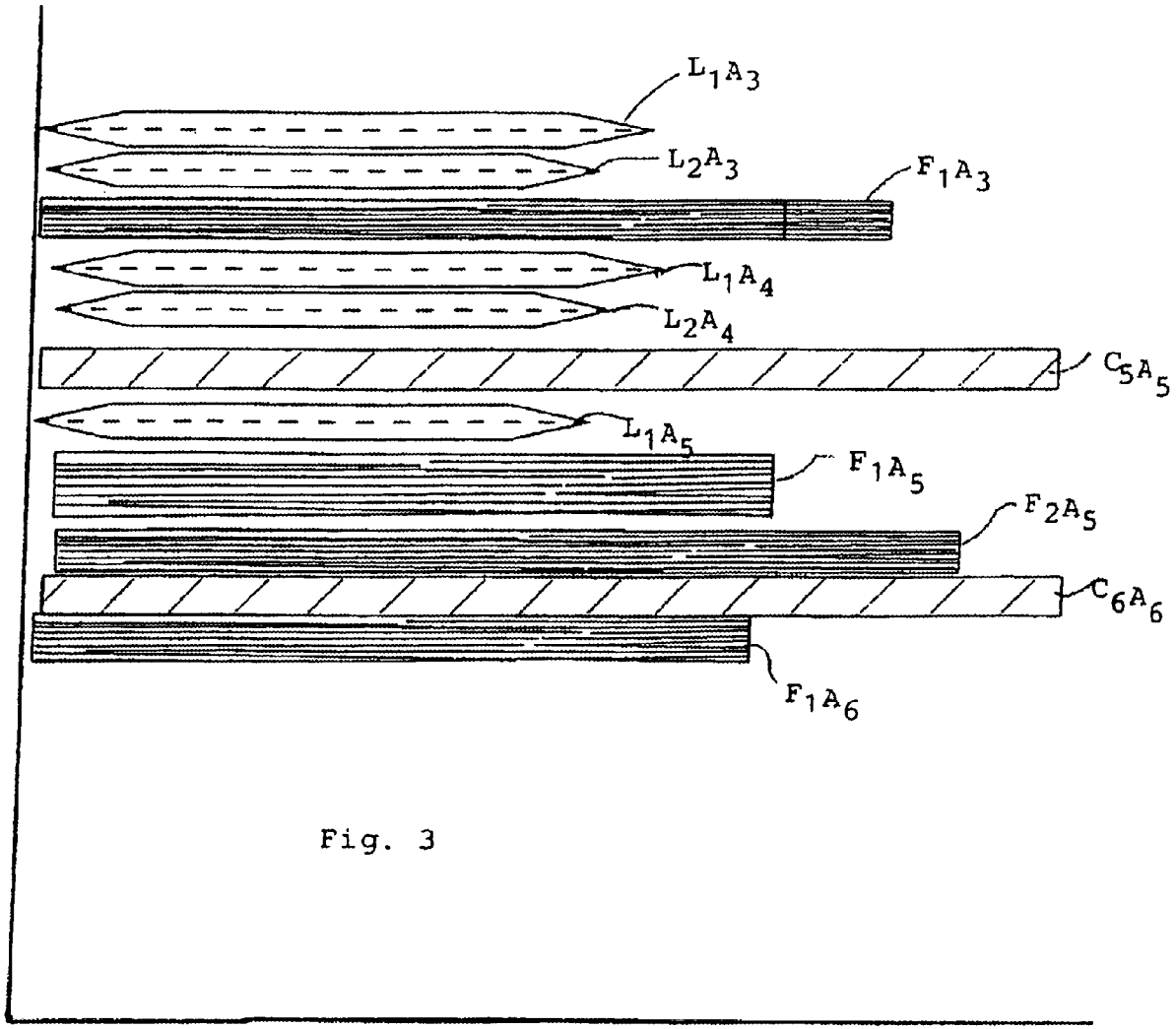
FIG. 3 is an illustration of a stack of mail pieces and separators sorted in accordance with a second method of the invention.

In this variation of the method, after the mail pieces have been processed through a first pass through sorter 10, a stack of separator cards is loaded onto feeder 12. Under the direction of computer 20, the required number of separator cards are fed and directed to the appropriate bins so that the separator cards will be sorted into the locations where the same type of mail pieces are directed to consecutive addresses on the carrier's route in one or more subsequent passes through sorter 10. Thus, as illustrated in FIG. 3, after the last pass through sorter 10 the stack, ordered in accordance with the sequence of stops on the carrier's route, would include separator cards as follows:

$L_1, A_3$
$L_2, A_3$
$F_1, A_3,$
$L_1, A_4$
$L_2, A_4$
$C_5, A_5$
$L_1, A_5$
$F_1, A_5$
$F_2, A_5,$
$C_6, A_6$
$F_1, A_6$

Since adjacent mail pieces of different types, i.e. a letter followed by a flat, addressed to consecutive addresses can be readily separated due to the different physical dimensions of these mail pieces, a separator card is not required at these locations. Further the mail carrier will know that absent a separator card, adjacent mail pieces of the same type are destined for delivery to the same address and adjacent mail pieces of different types are destined for different addresses, further simplifying the process.

One advantage of the foregoing variation over the first method described herein, is that the number of separator cards required is minimized by utilizing flats as separators between letters addressed to consecutive addresses on the carrier's route.

As will be appreciated, the number of passes required to place a stack of mail, including separator cards, in delivery order will depend upon the number of bins available to the sorter and the number of different addresses on the carrier's route. Thus, more than two passes may be required, and it may be advantageous for the separator cards to be added to the mail pieces subsequent to different passes, depending upon a number of factors. Thus, the separator cards may not be added to the mail pieces after the first pass if more than two passes are required to sort the mail into delivery order for the carrier's route.

While the invention has been described in connection with the exemplary embodiments it will be understood that the invention is not limited to the specific embodiments shown. Thus, it will be appreciated that many modifications, combinations, methods, and subcombinations of the invention may be made without departing from the spirit and scope of the appended claims.

What is claimed is:

1. A method for sorting mail pieces for delivery by a carrier, wherein the mail pieces include both letters and flats, comprising:

a) sorting in a first sorting pass a batch of letters, each letter having a destination code thereon which corresponds to one of a predetermined number of delivery destinations for a carrier delivery route, using an automated sorting machine which scans each destination code and stores it in a computer memory;

b) sorting in a first sorting pass a batch of flats, each flat having a destination code thereon which corresponds to one of the predetermined number of delivery destinations for the carrier delivery route, using the same automated sorting machine which scans each destination code and stores it in a computer memory;

c) repeating steps (a) and (b) using the scanned and stored destination codes according to a computer-implemented sort scheme which results, after two or more sorting passes, in a series of groups of mail pieces, each corresponding to a delivery destination on the carrier delivery route, which groups may include letters only, flats only, or both letters and flats, and which groups are in delivery route order, and within each group mail pieces are divided into subgroups of letters and flats, which subgroups alternate with one another when two groups of mail having both letters and flats for their respective destinations are sorted in the series in delivery route order;

d) identifying those groups wherein the last mail piece in a group is of the same type as the first mail piece in the next group; and e) inserting a divider between adjacent groups in the series whenever a last mail piece in a group addressed to one destination is of the same type as a first mail piece in the next group.

2. The method of claim 1, wherein each delivery point corresponds to a ZIP+4 code.

3. The method of claim 1, wherein the mail pieces of each batch are sorted using a digit of a destination code.

4. The method of claim 1, wherein the mail pieces of each batch are sorted using selected digits of a destination code.

5. A method for sorting mail pieces for delivery by a carrier, wherein the mail pieces include both letters and flats, comprising:

a) sorting in a first sorting pass a batch of mail pieces, including letters and flats, each having a destination code thereon which corresponds to one of a predetermined number of delivery destinations for a carrier delivery route, using an automated sorting machine which scans each destination code and stores it in a computer memory;

b) determining the sequence of letters and flats that will result from a final pass wherein the scanned and stored destination codes are used to sort the mail according to a computer-implemented sort scheme which results in a series of groups of mail pieces, the groups being in delivery route order;

c) identifying consecutive groups wherein the last mail piece in a group is of the same type as the first mail piece in the next group; and d) in a second pass, inserting a divider between adjacent groups in the series whenever a last mail piece in a group addressed to one destination is of the same type as a first mail piece in the next group.

6. The method of claim 5, wherein each destination corresponds to a ZIP+4 code.

7. The method of claim 5, wherein the mail pieces of each batch are sorted using a digit of a ZIP+4 code.

8. The method of claim 5, wherein the mail pieces of each batch are sorted using selected digits of a destination code.

9. A method of sorting a batch of mail pieces including letters and flats each having a destination code thereon into a series of groups arranged in delivery order according to a carrier route comprising:

sorting the letters and flats in a first pass with an automated sorting machine that scans the destination code from each letter or flat and identifies the mail piece as a letter or flat;

storing the identity and destination code for each mail piece;

identifying consecutive groups in the series of groups wherein the last mail piece in a group is of the same type as the first mail piece in the next group; and inserting a divider between adjacent groups in the series when the last mail piece in a group is of the same type as the first mail piece in the next group.

* * * * *